US008607873B2

(12) United States Patent
Aadnoy

(10) Patent No.: US 8,607,873 B2
(45) Date of Patent: Dec. 17, 2013

(54) FLOW CONTROLLER DEVICE

(75) Inventor: Bernt Sigve Aadnoy, Sandnes (NO)

(73) Assignee: Bech Wellbore Flow Control AS, Sandness (NO)

( * ) Notice: Subject to any disclaimer, the term of this patent is extended or adjusted under 35 U.S.C. 154(b) by 170 days.

(21) Appl. No.: 12/990,470

(22) PCT Filed: May 5, 2009

(86) PCT No.: PCT/NO2009/000174

§ 371 (c)(1),
(2), (4) Date: Dec. 4, 2010

(87) PCT Pub. No.: WO2009/136796

PCT Pub. Date: Nov. 12, 2009

(65) Prior Publication Data

US 2011/0067878 A1 Mar. 24, 2011

(30) Foreign Application Priority Data

May 7, 2008 (NO) ..... 20082109

(51) Int. Cl.
*E21B 34/08* (2006.01)

(52) U.S. Cl.
USPC ..... 166/320; 166/373; 251/61.4

(58) Field of Classification Search
USPC ..... 166/319–321, 332.1, 373; 137/501, 137/500; 251/24, 61.4
See application file for complete search history.

(56) References Cited

U.S. PATENT DOCUMENTS

| | | | | |
|---|---|---|---|---|
| 1,699,676 | A * | 1/1929 | Rush | 137/501 |
| 2,154,223 | A * | 4/1939 | Wade | 138/26 |
| 2,235,304 | A * | 3/1941 | Toussaint | 251/45 |
| 2,579,334 | A * | 12/1951 | Plank | 251/54 |
| 3,028,876 | A * | 4/1962 | Gratzmuller | 137/501 |
| 3,123,094 | A * | 3/1964 | Toschkoff | 137/505.13 |
| 3,344,805 | A * | 10/1967 | Wapner | 137/486 |
| 3,870,436 | A * | 3/1975 | Remy | 417/299 |
| 4,210,171 | A * | 7/1980 | Rikuta | 137/501 |
| 4,250,915 | A * | 2/1981 | Rikuta | 137/501 |
| 5,234,025 | A * | 8/1993 | Skoglund et al. | 137/501 |
| 5,642,752 | A * | 7/1997 | Yokota et al. | 137/413 |
| 5,722,454 | A * | 3/1998 | Smith et al. | 137/503 |
| 5,971,012 | A * | 10/1999 | Skoglund | 137/501 |
| 6,325,153 | B1 * | 12/2001 | Harrell | 166/386 |
| 6,427,967 | B1 * | 8/2002 | Evans | 251/26 |
| 6,786,285 | B2 * | 9/2004 | Johnson et al. | 166/370 |
| 6,827,100 | B1 * | 12/2004 | Carlson | 137/454.6 |
| 6,929,026 | B1 * | 8/2005 | Arlinghaus, Jr. | 137/505.13 |

(Continued)

FOREIGN PATENT DOCUMENTS

| | | | |
|---|---|---|---|
| GB | 2 376 488 | A | 12/2002 |
| WO | WO-2008/004875 | A1 | 1/2008 |

*Primary Examiner* — Shane Bomar

*Assistant Examiner* — Blake Michener

(74) *Attorney, Agent, or Firm* — Tarolli, Sundheim, Covell & Tummino LLP

(57) ABSTRACT

A flow controller device for controlling a fluid flow between a petroleum reservoir and a pipe body is described. The fluid flow is carried through a flow restriction. A pressure-controlled actuator is connected to a valve body that cooperates with a valve opening. The valve opening is connected in series subsequent to the flow restriction. A closing side of the actuator communicates with fluid located upstream of the flow restriction. An opening side of the actuator communicates with a fluid located downstream of the flow restriction and upstream of the valve opening.

19 Claims, 3 Drawing Sheets

(56) References Cited

U.S. PATENT DOCUMENTS 7,819,196 B2 * 10/2010 Aakre ..... 166/369
2005/0056318 A1 * 3/2005 Arlinghaus, Jr. ..... 137/505.13
2008/0099081 A1 * 5/2008 Yamamoto ..... 137/497
2009/0078428 A1 * 3/2009 Ali ..... 166/373
2009/0218103 A1 * 9/2009 Aakre et al. ..... 166/373

* cited by examiner

FLOW CONTROLLER DEVICE

FIELD OF THE INVENTION

A flow controller is provided. More particularly, it involves a flow controller for controlling a fluid flow between a petroleum reservoir and a pipe body, in which the carried through a flow restriction.

BACKGROUND OF THE INVENTION

In wells of relatively long penetration into a reservoir, so-called uneven production easily occurs. This implies a dissimilar inflow of reservoir fluid along the well. The situation is mainly due to a pressure drop in the production tubing, and is particularly common in horizontal or near-horizontal wells.

In many of the wells, also in vertical or near-vertical wells, the situation may be due to dissimilar permeability, viscosity or pore pressure in different zones of the well.

The conditions underlying the invention are explained hereinafter with reference to a horizontal well. This does not limit the scope of the invention in any way.

Oftentimes, the inflow into the production tubing is substantially larger at the "heel" of the well than at the "toe" of the well. If this inflow is not controlled, the production will be uneven, which may lead to water or gas coning. This results in new wells having to be drilled in order to be able to recover well fluid from the region at the toe of the well.

It is known to provide chokes, termed ICD's (Inflow Control Devices) in the art, in the inflow path to the production tubing, for example at each pipe joint. The chokes may be adapted individually for the different zones of the well. As the pressure in the reservoir changes, the relative pressure between the different regions of the well changes too, whereby the originally adapted chokes oftentimes do not continue to control the inflow into the well in the desired manner.

GB 2376488 discloses a regulated valve for fluid inflow from a well to a pipe. The valve lacks proper feedback from the well pressure.

WO2008/004875 discloses a disc valve for the same purpose as above that is based on the Bemoulli effect of the flowing fluid against a disk.

SUMMARY OF THE INVENTION

The object of the flow controller is to remedy or reduce at least one of the disadvantages of the prior art.

The object is achieved in accordance with the invention and by virtue of the features disclosed in the following description and in the subsequent claims.

A flow controller is provided for controlling a fluid flow between a petroleum reservoir and a pipe body, in which the fluid flow is carried through a flow restriction. The flow controller is characterized in that a pressure-controlled actuator is connected to a valve body cooperating with a valve opening, connected in series relative to the flow restriction, wherein the actuator, on a closing side thereof, communicates with fluid located upstream of the flow restriction, and wherein the actuator, on a opening side thereof, communicates with a fluid located downstream of the flow restriction and upstream of the valve opening.

Upon inflow into the pipe body, herein a production tubing, it is assumed that the pressure drop within a relatively long well is affected mainly by the following conditions:

The draw-down pressure of the reservoir, which controls the flow rate from the reservoir. This is affected by the permeability of the reservoir, exposed formation area and viscosity of the well fluid.

The pressure drop along the production tubing. This pressure drop depends on the accumulated flow through the production tubing. For horizontal wells exhibiting a relatively high production, the flow is laminar, i.e. viscosity-dependent, at the foe of the well, but it changes into a turbulent flow, which is density-dependent, as the flow velocity increases. Thus, the flow rate relative to the pressure drop is highly non-linear and varies with the specific rate of recovery.

The pressure-drop characteristic across the ICD is an important parameter. Modelling has proved that the flow restriction normally exhibits turbulent and thereby non-linear flow.

Thus, the pressure drop in a well is relatively complicated and is laminar within the reservoir, turbulent through the ICD, laminar and turbulent in the production tubing, and turbulent from the heel of the well.

During the inflow into the pipe body, the reservoir pressure is reduced by means of a flow restriction. The force balance on a piston of the actuator is given by:

$$P_rA-P_cA-KX=0$$

where Pr is the reservoir pressure. A is the piston area, Pc is the pressure in an inflow chamber located downstream of the flow restriction and upstream of the valve opening, K is the spring constant of a spring and X is the movement of the spring-loaded piston.

A pressure balance at a valve opening between the inflow chamber and the production tubing is given by:

$$P_c-P_t=K_v\rho Q^2$$

where Pt is the pressure within the production tubing, Kv is the valve constant, ρ is the density of the well fluid and Q is the flow rate of the fluid through the valve opening.

By combining the two equations above, the equation for a constant-flow flow controller is obtained:

$$P_r - P_t = \frac{KX}{A} + K_v\rho Q^2$$

which may be transformed into:

$$Q = \sqrt{\frac{1}{K_v\rho}\left[(P_r - P_t) - \frac{KX}{A}\right]}$$

The spring force KX has been calibrated in such a way that the piston is moved as the differential pressure changes. The term under the square root is always constant, whereby also the flow will be constant, insofar as a large pressure drop across the valve opening results in a large movement X of the piston, K and A being constants:

$$(P_r - P_t) = \frac{KX}{A}$$

The closing side of the actuator may communicate with fluid located on the inside of a sand screen. Thereby, cleaner fluid is supplied to the actuator than should the supply come directly from the reservoir.

The actuator may be provided with a piston which is movable in a sealing manner within a cylinder. This is provided the flow controller, and thereby also the actuator, is to have a long life, which may be enhanced by separating the piston from the well fluid by means of at least one diaphragm-resembling gasket.

Typically, the actuator piston is spring-biased in a direction away from the valve opening.

In a simplified embodiment, and to substitute the piston, the actuator may be formed with a diaphragm, the diaphragm also having a spring constant. This implies that the force required to move the diaphragm increases with the distance of relative movement.

The operation of the flow controller is explained in further detail below. In the exemplary embodiments, the flow controller delivers fluid directly to the pipe body. It is evident that the flow controller may be placed anywhere in the flow path from the petroleum reservoir to the pipe body.

The flow controller is also suitable for use in vertical or near-vertical wells, which oftentimes may penetrate several reservoir layers of dissimilar permeabilities, viscosities and reservoir pressures, insofar as the flow controllers may be set so as to be able to maximize the recovery from all layers.

During the production time of a petroleum well, the flow controller provided allows for a substantially improved control of the inflowing well fluid. The flow controller may be designed so as to provide a constant flow rate despite a drop in the well pressure, or it may be designed so as to change the flow rate as a function of the well pressure or the pressure difference between the well and the production tubing.

BRIEF DESCRIPTION OF THE DRAWINGS

In what follows is described an example of a preferred embodiment is described in the following and is depicted on the accompanying drawings, in which.

DETAIL DESCRIPTION OF THE INVENTION

Figure 1:
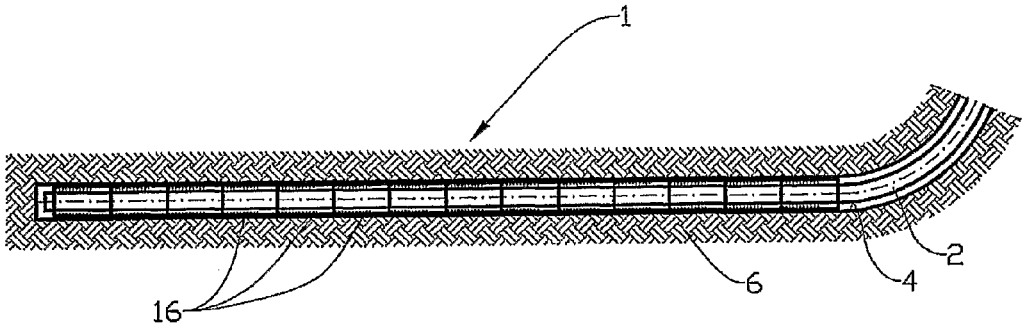
FIG. 1 shows a schematic cross section of a relatively elongated, horizontal well divided into a number of zones.

In the drawings, reference numeral 1 denotes a petroleum well having a pipe body 2 in the form of a production tubing disposed within a borehole 4 in a reservoir 6.

Figure 2:
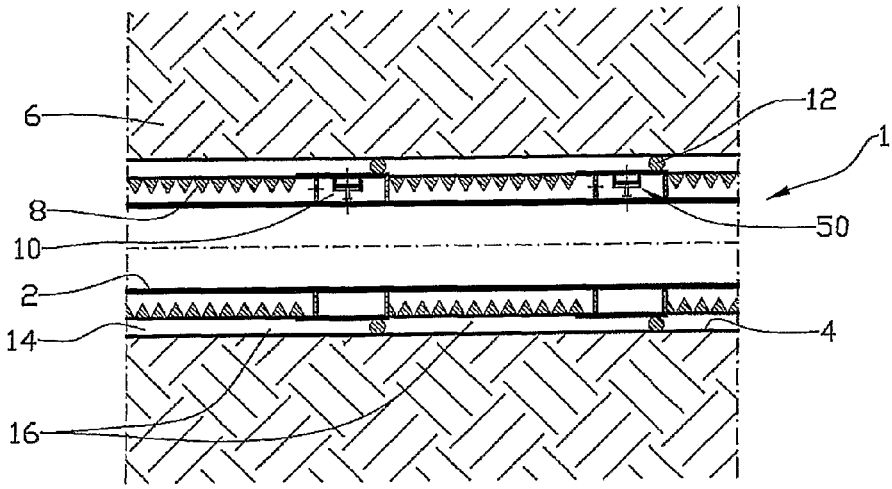
FIG. 2 shows, on a larger scale, a section of FIG. 1.
Figure 3:
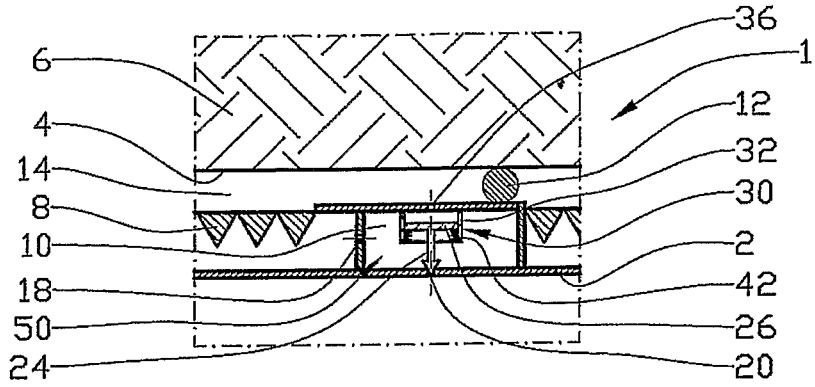
FIG. 3 shows, on a larger scale and in cross section, a principle drawing of a flow controller.
Figure 4:
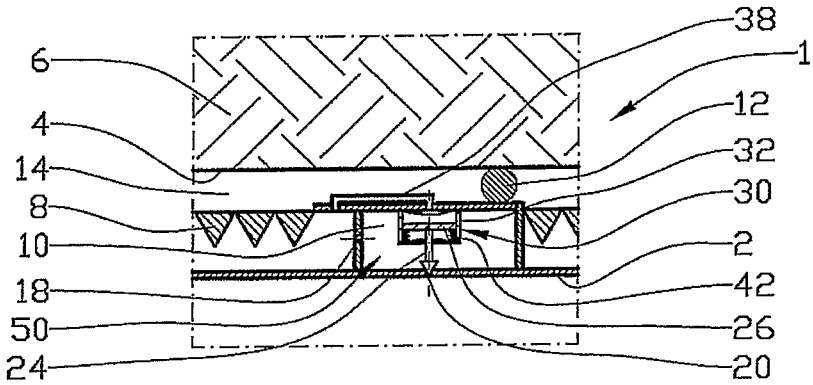
FIG. 4 shows a cross section of another embodiment of the flow controller of FIG. 3.

The pipe body 2 is provided with completion equipment in the form of sand screens 8 and inflow chambers 10, see FIG. 2.

A number of packers 12 are arranged in an annulus 14 between the sand screen 8 and the borehole 4, dividing the well 1 into a number of sections 16.

Well fluid flows via the sand screen 8 and a flow restriction 18 in the form of a nozzle, see FIGS. 3 to 6, into the inflow chamber 10 and further through a valve opening 20 and into the pipe body 2. The flow restriction 18 may be adjustable.

Figure 5:
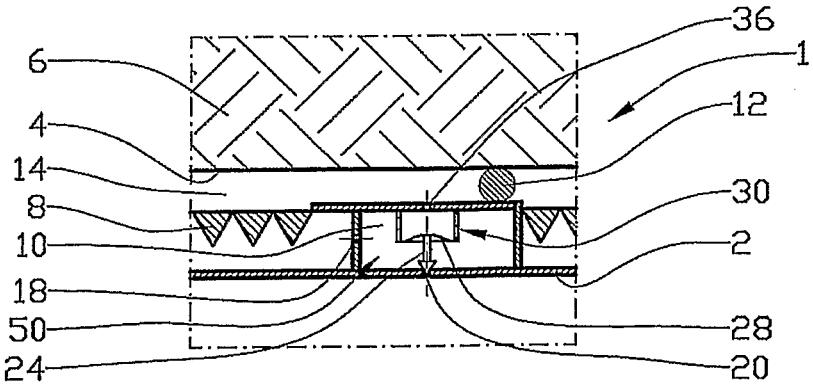
FIG. 5 shows a cross section of yet another embodiment of the flow controller.
Figure 6:
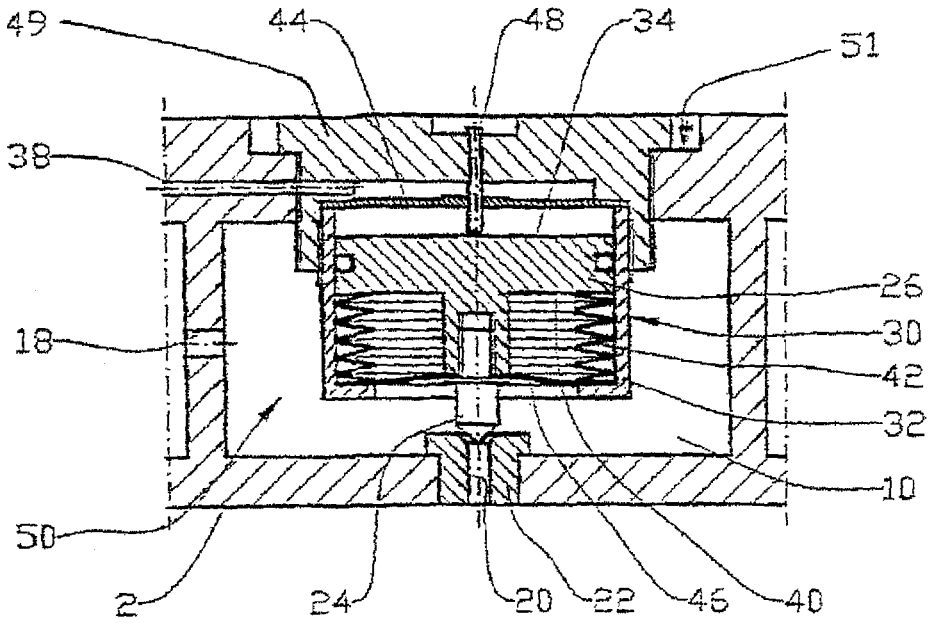
FIG. 6 shows, in cross section and on a larger scale, a flow controller in a practical embodiment thereof.

The valve opening 20 is located in a valve seat 22 cooperating with a valve body 24, see FIG. 6. The valve body 24 is connected to a piston 26, see FIGS. 3, 4 and 6, or to a diaphragm 28, see FIG. 5, in an actuator 30.

Should the actuator 30 be provided with a piston 28, the piston 26 is movable in a sealing manner within a cylinder 32. Relative to the valve seat 22, the closing side 34 of the piston 26, see FIG. 6, is located at the opposite side of the piston 26 and communicates with the reservoir pressure via an opening 36 into the annulus 14, see FIG. 3, or via a conduit 38 to within the sand screen 8, see FIG. 4. The pressure in the inflow chamber 10 acts against the opening side 40 of the piston.

A spring 42 biases the piston 26 in a direction away from the valve seat 22.

The well pressure and the pressure in the inflow chamber act on the diaphragm 28, see FIG. 5, in a corresponding manner. The diaphragm 28 is relatively stiff, and the required moving force increases as the valve body 24 is moved in the direction away from the valve seat 22.

In FIG. 6, the actuator is formed with a first diaphragm-resembling seal 44 at its closing side 34, and a second diaphragm-resembling seal 46 at its opening side 40.

The cylinder 32 is oil-filled between the seals 44 and 46. The piston 26 is therefore not exposed to reservoir fluid.

A calibrating screw 48 acts against the piston 26 so as to contribute to allow pre-tensioning of the spring 42. The first seal 44 communicates with the reservoir pressure via the conduit 38. The reservoir pressure is transmitted to the piston 26 via the fluid located between the first seal 44 and the piston 26.

The flow restriction 18, the inflow chamber 10, the actuator 30 and the valve seat 22 with the valve body 24 thus comprise a flow controller 50. The flow controller 50 is inserted into the inflow chamber 10 from a region thereof closest to the petroleum reservoir 6 to thereby close the chamber 10. In one example, a cap 49 of the flow controller 50 is inserted into a corresponding opening 51 of the chamber 10 provided in the pipe body 2 to close the chamber 10.

When the flow controller 50 is in equilibrium and the reservoir pressure drops, the pressure difference $Pr-Pt=\Delta P$ between the reservoir 6 and the pipe body 2 becomes smaller, which leads to reduced inflow of reservoir fluid into the pipe body 2 in the event of not changing the pressure drop in the How controller 50.

However, the theoretical deduction in the general part of the document shows that the spring 42, alternatively the diaphragm 28, moves the piston 28 and the diaphragm 28, respectively, so as to reduce the pressure drop across the valve body 24 and valve opening 20, whereby the flow rate through the flow controller remains unchanged. The relationship is shown by means of a curve 52 in FIG. 7, showing the pressure difference $\Delta P$ along the abscissa and the flow rate Q along the ordinate.

Figure 7:
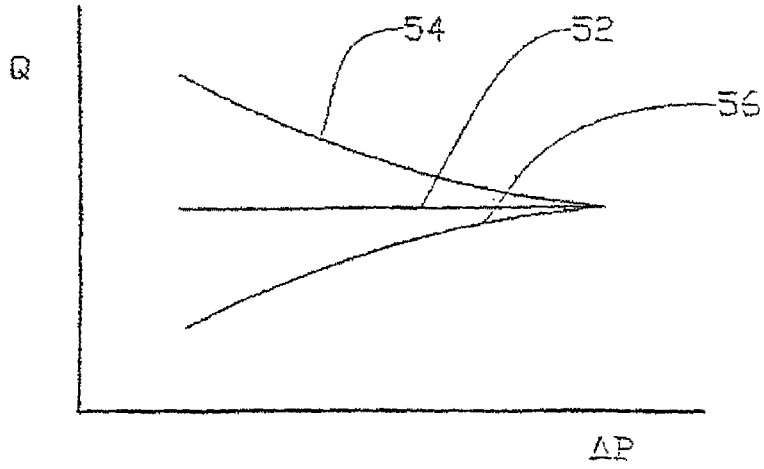
FIG. 7 shows a graph of various flow characteristics of the flow controller.

A curve 54 in FIG. 7 illustrates the flow when the flow controller 50 is structured in a manner allowing it to provide an increasing flow rate Q in response to a decreasing differential pressure $\Delta P$, whereas a curve 56 shows the flow when the flow controller 50 is structured in a manner allowing if to provide a decreasing flow rate Q in response to a decreasing differential pressure $\Delta P$.

The invention claimed is:

1. A device configured to control a fluid flow between a petroleum reservoir (6) and a pipe body (2), wherein an inflow chamber (10) is provided externally of the pipe body (2) and attached to or integral with the pipe body (2), the inflow chamber being interactive with a flow controller (50), wherein the flow controller (50) is inserted into the inflow chamber (10) from a region thereof closest to the petroleum reservoir (6) and thereby closing the chamber (10) thereat, wherein a wall of the inflow chamber (10) has a fluid flow restriction (18) in communication with a borehole (4) annulus (14) between the reservoir (6) and the pipe body (2), the flow restriction (18) being interactive with the flow controller (50), wherein the inflow chamber (10) communicates with an interior of the pipe body (2) via a valve seat (22) inserted in the pipe body (2), the valve seat (22) having a through-going valve opening (20), wherein the flow controller (50) has a cylinder (32) and a piston (26) movable inside the cylinder, the piston (26) having a first or closing side (34) facing in a direction of the reservoir (6) and a second or opening side (40) facing in a direction of the pipe body (2), wherein the piston (26) is spring-loaded by a spring (42) extending between a bottom region of the cylinder (10) and said second side (40) of the piston, the bottom region having an opening, wherein the second side (40) of the piston (26) has a piston rod surrounded by the spring (42), wherein a valve body (24) is attached to the piston rod, the valve body (24) being configured to interact with said valve seat (22) to control flow rate through the valve opening (20), said valve body (24) and said valve seat (22) being interactive with the flow controller (50), wherein a first end of the cylinder (32) closest to the reservoir (6) is sealed off by a first diaphragm (44), and the cylinder bottom region opening being sealed off by a second diaphragm (46), the valve body (24) extending through the second diaphragm (46) in a sealed manner, wherein a face of the first diaphragm (44) which faces away from an interior of the cylinder (32) is in communication with the annulus (14), and wherein alterations of any pressure difference (ΔP) between a pressure (Pr) from the reservoir (6) and a pressure (Pt) in the pipe body (2) and in the inflow chamber (10) act on said first and second diaphragms (44, 46) to control movement of the piston (26) within the cylinder (32) and thereby a location of the valve body (24) relative to the valve seat (22) to yield a specific fluid flow rate through the valve opening (20).

2. The device according to claim 1, wherein an available cylinder space between the first and second diaphragms (44, 46) is filled with oil.

3. The device according to claim 2, wherein the spring (42) is compressed when a pressure acting on the first diaphragm (44) is greater than a pressure acting on the second diaphragm.

4. The device according to claim 1, wherein the flow restriction (18) is spaced apart from the flow controller (50).

5. The device according to claim 1, wherein the flow restriction (18) is adjustable.

6. The device according to claim 1, wherein a sand screen (8) is provided externally of the inflow chamber (10), the sand screen (8) facing the annulus (14) and leaving a space between the sand screen (8) and the pipe body (2), fluid from the reservoir (6) thereby passing through the sand screen (8), said space, and through the flow restriction (18) into the inflow chamber (10).

7. The device according to claim 6, wherein a fluid pressure which acts on the first diaphragm (44) is communicated from the annulus via the sand screen (8), the space, and a conduit (38) to the first diaphragm (44).

8. The device according to claim 6, wherein a packer (12) is located in the annulus (14) between the reservoir (6) and a body part of the inflow chamber (10) which faces the reservoir (6), thereby yielding that the sand screen (8) and flow control device (50) with the flow restriction (18), inflow chamber (10), valve body (24), and valve seat (22) form a section (16) of a well (1) when the well (1) is subdivided into a plurality of such sections (16) by respective packers (12).

9. The device according to claim 1, wherein a calibration screw (48) extends from the flow controller (50) to a position outside the inflow chamber (10) adjacent the annulus (14) through the first diaphragm (44) to engage the first side (34) of the piston (26) to set a pre-tensioning of the spring (42).

10. The device according to claim 1, wherein the valve seat (22) that interacts with a conical end of the valve body (24) has a recess of truncated cone configuration.

11. The device according to claim 1, wherein alterations of any pressure difference (ΔP) between the pressure (Pr) from the reservoir (6) and the pressure (Pt) in the pipe body (2) and in the inflow chamber (10) act on said first and second diaphragms (44, 46) to control movement of the piston (26) within the cylinder (32) and thereby a location of the valve body (24) relative to the valve seat (22) to yield a constant fluid flow rate through the valve opening (20).

12. A device configured to control a fluid flow between a petroleum reservoir (6) and a pipe body (2), wherein an inflow chamber (10) is provided externally of the pipe body (2) and attached to or integral with the pipe body (2), the inflow chamber being interactive with a flow controller (50), wherein the flow controller (50) is inserted into the inflow chamber (10) from a region thereof closest to the petroleum reservoir (6) and thereby closing the chamber (10) thereat, wherein a wall of the inflow chamber (10) has a fluid flow restriction aperture (18) in communication with a borehole (4) annulus (14) between the reservoir (6) and the pipe body (2), the flow restriction (18) being interactive with the flow controller (50), wherein the inflow chamber (10) communicates with an interior of the pipe body (2) via a valve seat (22) inserted in the pipe body (2), the valve seat (22) having a through-going valve opening (20), wherein the flow controller (50) has a cylinder (32) closed off at an end closest to the pipe body (2) by means of a diaphragm (28), the diaphragm (28) having a first side facing in a direction of the reservoir (6) and a second side facing in a direction of the pipe body (2), wherein a valve body (24) is attached to the diaphragm (28), the valve body (24) being configured to interact with said valve seat (22) to control flow rate through the valve opening (20), said valve body (24) and said valve seat (22) thus being interactive with the flow controller (50), wherein the first face of the diaphragm (28) which faces in a direction towards the reservoir is in communication with the annulus (14) and thus fluid from the reservoir (6), and wherein alterations of any pressure difference (ΔP) between a pressure (Pr) from the reservoir (6) and a pressure (Pt) in the pipe body (2) and in the inflow chamber (10) act on said first and second sides of the diaphragm (28), respectively, to control movement of the diaphragm (28) and thereby a location of the valve body (24) relative to the valve seat (22) to yield a specific fluid flow rate through the valve opening (20).

13. The device according to claim 12, wherein the diaphragm has limited elasticity.

14. The device according to claim 12, wherein the flow restriction (18) is spaced apart from the flow controller (50).

15. The device according to claim 12, wherein the flow restriction (18) is adjustable.

16. The device according to claim 12, wherein a sand screen (8) is provided externally of the inflow chamber (10), the sand screen (8) facing the annulus (14) and leaving a space between the sand screen (8) and the pipe body (2), fluid from the reservoir (6) thereby passing through the sand screen (8), said space, and through the flow restriction (18) into the inflow chamber (10).

17. The device according to claim 16, wherein a packer (12) is located in the annulus (14) between the reservoir (6) and a body part of the inflow chamber (10) which faces the reservoir (6), thereby yielding that the sand screen (8) and flow control device (50) with the flow restriction (18), inflow chamber (10), valve body (24), and valve seat (22) form a section (16) of a well (1) when the well (1) is subdivided into a plurality of such sections (16) by respective packers (12).

18. The device according to claim 12, wherein the valve seat (22) that interacts with a conical end of the valve body (24) has a recess of truncated cone configuration.

19. The device according to claim 12, wherein alterations of any pressure difference ($\Delta P$) between the pressure (Pr) from the reservoir (6) and the pressure (Pt) in the pipe body (2) and in the inflow chamber (10) act on said first and second side of the diaphragm (28) respectively, to control movement of the diaphragm (28) and thereby a location of the valve body (24) relative to the valve seat (22) to yield a constant fluid flow rate through the valve opening (20).

* * * * *

UNITED STATES PATENT AND TRADEMARK OFFICE

CERTIFICATE OF CORRECTION

PATENT NO. : 8,607,873 B2
APPLICATION NO. : 12/990470
DATED : December 17, 2013
INVENTOR(S) : Bernt Sigve Aadnoy It is certified that error appears in the above-identified patent and that said Letters Patent is hereby corrected as shown below:

On the Title Page, Item (73) Assignee
Change "Sandness" to --Sandnes--

Signed and Sealed this
Twenty-ninth Day of April, 2014

Michelle K. Lee

Michelle K. Lee
*Deputy Director of the United States Patent and Trademark Office*